US006807696B2

(12) United States Patent
Magistretti

(10) Patent No.: US 6,807,696 B2
(45) Date of Patent: Oct. 26, 2004

(54) DEVICE FOR ADJUSTING THE POSITION OF A CUSHION RELATIVE TO A MATTRESS OR SITTING SURFACE

(75) Inventor: Vico Magistretti, Milan (IT)

(73) Assignee: Flou S.p.A., Meda (IT)

( * ) Notice: Subject to any disclaimer, the term of this patent is extended or adjusted under 35 U.S.C. 154(b) by 0 days.

(21) Appl. No.: 10/375,244

(22) Filed: Feb. 27, 2003

(65) Prior Publication Data

US 2003/0167570 A1 Sep. 11, 2003

(30) Foreign Application Priority Data

Mar. 6, 2002 (IT) ..... MI2002A0465

(51) Int. Cl.[7] ..... A47C 20/00

(52) U.S. Cl. ..... 5/633; 5/658; 5/652; 5/657; 297/284.5; 297/397

(58) Field of Search ..... 5/633, 652, 657, 5/658; 297/284.5, 397, 284.7, 220

(56) References Cited

U.S. PATENT DOCUMENTS 2,591,306 A * 4/1952 Sherman ..... 297/284.5
2,775,999 A * 1/1957 Goodeve ..... 297/353
5,551,752 A * 9/1996 Lovegrove et al. ..... 297/284.5

FOREIGN PATENT DOCUMENTS

FR 2 657 240 A 7/1991
GB 258 350 A 9/1926
GB 385 441 A 12/1932

* cited by examiner

*Primary Examiner*—Teri Pham Luu
(74) *Attorney, Agent, or Firm*—Herbert Dubno

(57) ABSTRACT

Device for adjusting the height of a cushion (1) with respect to the surface of a mattress or seat (12) of a bed/sofa (10) which has a headboard or backrest (13;113), comprising a strip of fabric (21) which is fastened to the cushion and one end of which is joined to a weight (22).

12 Claims, 1 Drawing Sheet

DEVICE FOR ADJUSTING THE POSITION OF A CUSHION RELATIVE TO A MATTRESS OR SITTING SURFACE

FIELD OF THE INVENTION

The present invention relates to a device for adjusting the height of a cushion with respect to the surface of a mattress or seat of a bed/sofa equipped with a headboard or backrest.

BACKGROUND OF THE INVENTION

It is known in the art of manufacturing beds, sofas and the like that there exists the need to allow the user to adjust the height of the cushion with respect to the surface of the mattress or the seat, so as to ensure maximum comfort and a correct posture in the various positions which the user may assume depending on his/her particular requirements, for example, if he/she is simply resting, reading, etc.

It is also known that numerous mechanisms able to perform said adjustment have been proposed, said mechanisms, however, being complex, bulky and costly.

OBJECTS OF THE INVENTION

The object of the invention is to provide a device for adjusting the height of a cushion with respect to the surface of a mattress or seat of beds/sofas and the like, which can be easily applied, has compact dimensions and is simple to use also for a non-specialized user.

A further object is to provide a device which is easy to adapt to already existing beds/sofas which are not specifically designed for use therewith and which is concealable within the configuration of the bed/sofa so as to not alter significantly the overall appearance thereof.

SUMMARY OF THE INVENTION

These objects are attained according to the present invention by a device for adjusting the height of a cushion with respect to the surface of a mattress or seat of a bed/sofa equipped with a headboard or backrest, comprising a strip of fabric which is fastened to the cushion and one end of which is joined to a weight.

BRIEF DESCRIPTION OF THE DRAWING

Further details may be obtained from the following description of non-limiting embodiments of the invention, provided with reference to the accompanying drawing, in which.

SPECIFIC DESCRIPTION

Figure 1:
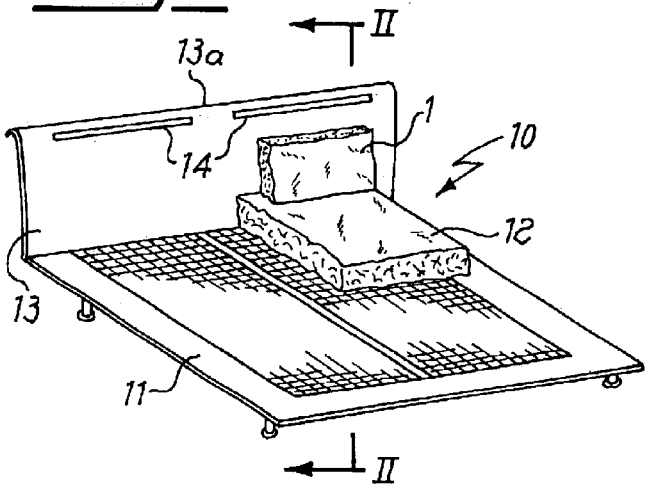
FIG. 1 is a perspective view of a bed with a device according to the present invention, according to a first embodiment thereof.

As illustrated in FIG. 1, a bed 10 with a device 20 according to the present invention for adjusting the height of the cushion 1 with respect to the mattress comprises: a longitudinal surface 11 supporting the mattress 12 itself and a headboard 13 which extends transversely with respect to the said surface of the mattress and against which the cushion 1 is rested.

Figure 2:
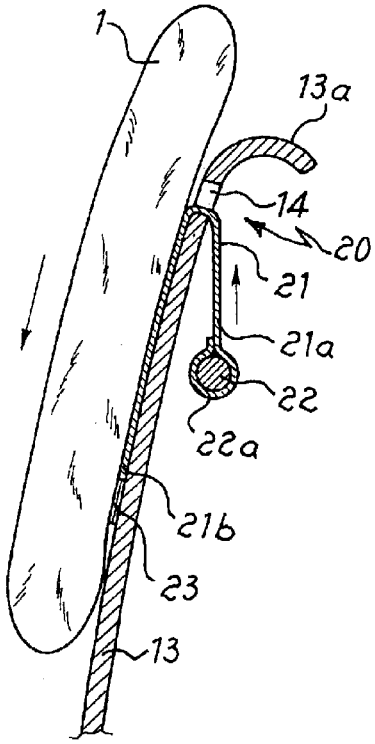
FIG. 2 is a schematic cross-section along the plane indicated by the line II—II in FIG. 1, with the cushion lowered.

FIG. 2 shows how, in a first embodiment, the adjusting device 20 according to the invention consists of a strip of fabric 21 which has at one end 21*a* a pocket 22*a* which extends parallel to the headboard 13 and which has, arranged inside it, a weight 22, for example in the form of a metal bar.

The end 21*b* of the strip 21, opposite to that of the weight 22, is fixed to the cushion 1 in a suitable position on surface thereof which makes contact with the headboard.

In a first embodiment of the device according to the invention it is envisaged that the means for fastening the strip 21 to the cushion 1 are of the irreversible type and for example consist of stitching.

In a second embodiment of the device according to the invention, on the other hand, it is envisaged that the means for fastening the strip 21 to the cushion 1 are of the reversible type and consist of a band 23 of material which is able to be attached/detached to/from the fabric of the cushion 1 so as to retain the latter and which is applied to the surface 21*a* of the strip 21.

An example of this fabric is known, for example, by the name of "velcro". While in the case of an irreversible fastening, the pocket 22a which carries the weight 22 is advantageously open so as to allow the extraction of the weight 22, in the case of a reversible fastening the pocket is advantageously closed so as to prevent the weight from accidentally coming out.

If the bed is specifically designed for use with the adjusting device 20, it is envisaged that the headboard 13 is provided with slits 14 extending parallel to the headboard 13 itself. Said slits 14 may each have a suitable length and be arranged at a suitable distance from the free edge 13*a* of the headboard 13.

Advantageously the slits 14 consist of a number equal to the number of cushions 1 so as to allow adjustment without any interference between them.

The operating principle of the device is essentially the same for both the embodiments.

In the case of the first embodiment (irreversible fastening):

once the strip 21 of fabric has been prepared, together with the weight 22, the opposite end is fastened to the cushion 1 by means of stitching;

the end with pocket 22*a* of the strip 21 is passed through the slit 14 from the inside towards the outside of the headboard so that the pocket is situated behind the headboard itself;

the bar 22 is inserted inside the pocket 22*a;*

In the case of the second embodiment (reversible fastening)

once the strip 21 of fabric has been prepared with the velcro band 23 and the weight 22 inserted and closed inside the end pocket;

the free end of the strip 21 opposite to that of the weight 22 is inserted into the slit 14 from the outside towards the inside so that the weight remains at the rear of the headboard 13;

the cushion 1 is rested on the strip part 21 which is hanging on the inside of the headboard and equipped with velcro 23, so that they are joined together.

Figure 3:
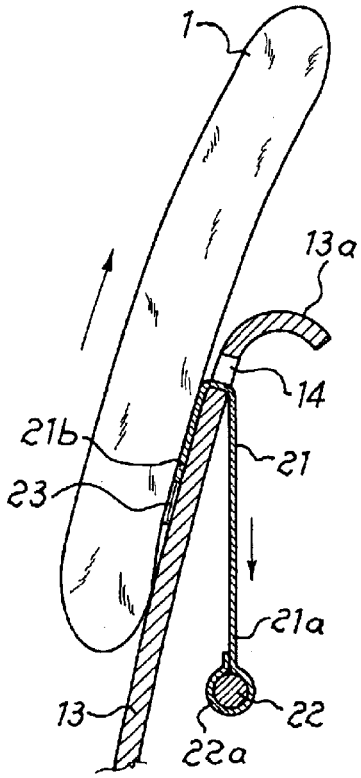
FIG. 3 is a view similar to that of FIG. 2, with the cushion raised.

In the case of both the embodiments:

at this point a pushing force upwards/downwards applied by the user to the cushion 1 causes discharging of the vertical force acting on the inner band and a corresponding downward (FIG. 3)/upward (FIG. 2) movement of the weight 22 which, being of a suitable size, balances the weight of the cushion, keeping it fixed in any desired position.

The embodiment with reversible fastening basically allows the cushion to be detached completely from the device, for example in order to turn over the cushion and change the surface against which the user rests or change the cover.

Figure 4:
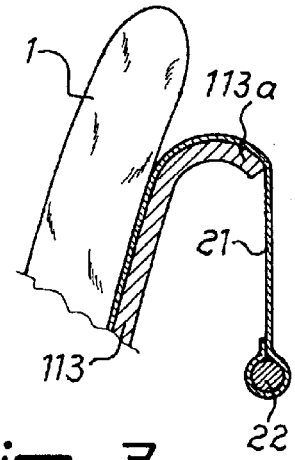
FIG. 4 is a cross-section similar to the preceding ones, with the device applied to a bed which is not specifically designed for use therewith.

As shown in FIG. 4, it is possible furthermore to use advantageously the device according to the invention also with beds which are not specifically designed for fitting of the said device; in this case it will be sufficient to pass the strip 21 of fabric over the free edge 113*a* of the headboard 113 so as to obtain the same counter-acting effect of the weight 22. Although described in connection with a bed, it is clear from the above description that the device may also be applied to sofas, armchairs and the like.

What is claimed is:

1. A device for adjusting the height of a cushion with respect to the surface of a mattress or seat structure of a bed or sofa which has a headboard or backrest member comprising in combination with said cushion, said structure and said member, of a strip of fabric which is fastened to the cushion and one end of which is joined to a weight, the end of the strip opposite to the weight comprising means for fastening the strip to the cushion and wherein said fastening means are of the reversible type.

2. The according to claim 5, wherein said means for fastening the strip to the cushion are able to be joined to the fabric thereof.

3. The device according to claim 2, wherein said means for fastening consists of a strip of velcro.

4. The device according to claim 1, said fastening means consists of a zip fastener.

5. The device according to claim 1, wherein the end of the strip joined to said weight has a pocket receiving said weight and said pocket has at least one open end.

6. A device for adjusting the height of a cushion with respect to the surface of a mattress or seat structure of a bed or sofa which has a headboard or backrest member comprising in combination with said cushion, said mattress or seat structure and said headboard or backrest member, said device comprising a strip of fabric which is fastened to the cushion and one end of which is joined to a weight, the end of the strip opposite to the weight comprising means for fastening the strip to the cushion and wherein the end of the strip joined to said weight has a pocket receiving said weight and said pocket has at least one open end and said headboard or backrest member has a slit through which the strip passes.

7. A bed or sofa comprising a surface for a mattress or seat structure, a headboard or backrest member and a cushion resting against said headboard or backrest member, and a device for adjusting the relative position of the said cushion and the mattress or seat structure, said device comprising a strip of fabric which is fastened to the cushion and one end of which is joined to a weight, the end of the strip opposite to the weight comprising means for fastening the strip to the cushion said means for fastening being of the reversible type.

8. The bed or sofa according to claim 7, characterized in that said means for joining to the cushion are able to be joined to the fabric thereof.

9. The bed or sofa according to claim 8 wherein said means for fastening consist of a strip of velcro.

10. The bed or sofa according to claim 7 wherein said reversible fastening means consist of a zip fastener.

11. The bed or sofa according to claim 7, wherein the end of the strip joined to said weight has a pocket 4 receiving said weight and said pocket has at least one open end.

12. The bed or sofa according to claim 7, wherein the end of the strip joined to said weight has a pocket receiving said weight and said pocket is closed.

* * * * *